US009823612B2

(12) United States Patent
Numazu et al.

(10) Patent No.: US 9,823,612 B2
(45) Date of Patent: Nov. 21, 2017

(54) PRINTING DEVICE

(71) Applicant: CASIO COMPUTER CO., LTD., Shibuya-ku, Tokyo (JP)

(72) Inventors: Toshihiko Numazu, Sayama (JP); Toshio Nagasaka, Iruma (JP); Toshiaki Yajima, Iruma (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 10 days.

(21) Appl. No.: 14/917,262

(22) PCT Filed: Sep. 5, 2014

(86) PCT No.: PCT/JP2014/073548
§ 371 (c)(1),
(2) Date: Mar. 7, 2016

(87) PCT Pub. No.: WO2015/037541
PCT Pub. Date: Mar. 19, 2015

(65) Prior Publication Data

US 2016/0216674 A1 Jul. 28, 2016

(30) Foreign Application Priority Data

Sep. 12, 2013 (JP) ..... 2013-189468

(51) Int. Cl.
*B65H 29/60* (2006.01)
*B65H 29/70* (2006.01)
(Continued)

(52) U.S. Cl.
CPC ..... *G03G 15/6552* (2013.01); *B41J 3/4075* (2013.01); *B41J 11/48* (2013.01);
(Continued)

(58) Field of Classification Search
CPC ..... B65H 29/70; B65H 29/58; B65H 29/60; B65H 2301/33312; B65H 2301/3332; B65H 2511/11; B41J 11/48; B41J 11/485
See application file for complete search history.

(56) References Cited

U.S. PATENT DOCUMENTS 4,941,377 A * 7/1990 Ishihara ..... B41J 11/48 226/110
5,012,295 A 4/1991 Ikkatai et al.
(Continued)

FOREIGN PATENT DOCUMENTS

JP 08113408 A 5/1996
JP 2009062100 A 3/2009
(Continued)

OTHER PUBLICATIONS

International Search Report (ISR) dated Nov. 4, 2014 issued in International Application No. PCT/JP2014/073548.
Chinese Office Action (and English translation thereof) dated Sep. 20, 2016, issued in counterpart Chinese Application No. 201480039719.4.

*Primary Examiner* — Luis A Gonzalez
(74) *Attorney, Agent, or Firm* — Holtz, Holtz & Volek PC

(57) ABSTRACT

A printing device includes a first ejector that ejects a recording medium to an exterior, a second ejector that enhances a rigidity of the recording medium more than by the first ejector, and ejects the recording medium to the exterior, and an ejector selector that selects either the first ejector or the second ejector.

4 Claims, 6 Drawing Sheets

(51) Int. Cl.

| | |
|---|---|
| ***G03G 15/00*** | (2006.01) |
| ***B41J 11/48*** | (2006.01) |
| ***B65H 29/58*** | (2006.01) |
| ***B65H 85/00*** | (2006.01) |
| ***B41J 3/407*** | (2006.01) |
| ***B41J 13/00*** | (2006.01) |
| ***B65H 31/24*** | (2006.01) |
| *G03G 15/23* | (2006.01) |

(52) U.S. Cl.

CPC ..... *B41J 11/485* (2013.01); *B41J 13/009* (2013.01); *B65H 29/58* (2013.01); *B65H 29/60* (2013.01); *B65H 29/70* (2013.01); *B65H 31/24* (2013.01); *B65H 85/00* (2013.01); *G03G 15/6573* (2013.01); *B65H 2301/12* (2013.01); *B65H 2301/3332* (2013.01); *B65H 2301/33312* (2013.01); *B65H 2301/51214* (2013.01); *B65H 2402/10* (2013.01); *B65H 2404/632* (2013.01); *B65H 2701/194* (2013.01); *B65H 2801/06* (2013.01); *G03G 15/234* (2013.01); *G03G 15/652* (2013.01); *G03G 15/6511* (2013.01); *G03G 15/70* (2013.01)

(56) References Cited

U.S. PATENT DOCUMENTS

| | | | | |
|---|---|---|---|---|
| 5,132,742 | A | 7/1992 | Goto | |
| 6,142,461 | A * | 11/2000 | Asao | B42C 1/12 270/58.09 |
| 8,544,841 | B2 | 10/2013 | Nakamura | |
| 8,746,685 | B1 * | 6/2014 | Fukuzawa | B65H 29/58 271/184 |
| 8,761,657 | B2 * | 6/2014 | Suzuki | B65H 29/22 399/397 |
| 2009/0056484 | A1 | 3/2009 | Hanashima et al. | |
| 2010/0192710 | A9 | 8/2010 | Hanashima et al. | |
| 2014/0091518 | A1 | 4/2014 | Nishii et al. | |
| 2015/0298472 | A1 * | 10/2015 | Kamitani | B41J 2/325 347/220 |

FOREIGN PATENT DOCUMENTS

| | | | |
|---|---|---|---|
| JP | 2011022254 | A | 2/2011 |
| JP | 2012001317 | A | 1/2012 |
| JP | 2014069951 | A | 4/2014 |

* cited by examiner

PRINTING DEVICE

TECHNICAL FIELD

The present disclosure relates to a printing device, an ejector selection method, and a program.

BACKGROUND ART

Printing devices capable of printing a cut sheet have become widely common over the past years.

According to such printing devices, paper ejecting rollers of stiffening a cut sheet are typically applied (see, for example, Patent Literature 1) to maintain a stable stacking performance of cut sheets that are to be ejected to a paper ejection tray. In this case, stiffening of the cut sheet means to enhance a rigidity of the cut sheet by bending the cut sheet in a wavy shape. By enhancing the rigidity of the cut sheet, curling of the cut sheet that is loaded on the paper ejection tray is prevented, and the stacking performance of the cut sheet on the paper ejection tray can be improved.

CITATION LIST

Patent Literature

Patent Literature 1: Unexamined Japanese Patent Application Kokai Publication No. 2012-1317

SUMMARY OF INVENTION

Technical Problem

When, however, label printing with a long roll paper, the roll paper is often wound by a winding mechanism after the ejection, and thus stiffening of the cut sheet is unnecessary in such a case. In particular, when stiffening is performed on the roll paper on which sticking papers, such as labels, are pasted, a load is applied to the stuck portions of the labels, causing the labels to be partly peeled off. When the labels have perforations in advance, such labels are especially likely to be peeled off.

When a printing device includes a mechanism (for example, fins in a wing-like shape) that slaps and pushes out a back end of the cut sheet in addition to the paper ejecting rollers of stiffening, a tip of the fin is stuck in the perforations of the labels, and thus the labels are further likely to be peeled off.

In view of such circumstances, a roll paper conveyance while reducing a load at the time of paper ejection has been desired.

Solution to Problem

A printing device according to an aspect of the present disclosure includes:

- a first ejector that ejects a recording medium to an exterior;
- a second ejector that enhances a rigidity of the recording medium more than by the first ejector, and ejects the recording medium to the exterior; and
- an ejector selector that selects either the first ejector or the second ejector.

In addition, an ejector selection method according to another aspect of the present disclosure is for a printing device that includes a first ejector that ejects a recording medium to an exterior, and a second ejector that enhances a rigidity of the recording medium more than by the first ejector, and ejects the recording medium to the exterior. The method includes an ejector selecting step of selecting either the first ejector or the second ejector.

Still further, a program according to the other aspect of the present disclosure causes a computer to execute an ejector selection method for a printing device that includes a first ejector that ejects a recording medium to an exterior, and a second ejector that enhances a rigidity of the recording medium more than by the first ejector, and ejects the recording medium to the exterior. The program further causing the computer to execute:

- an ejector selecting step of selecting either the first ejector or the second ejector.

DESCRIPTION OF EMBODIMENTS

Figure 1:
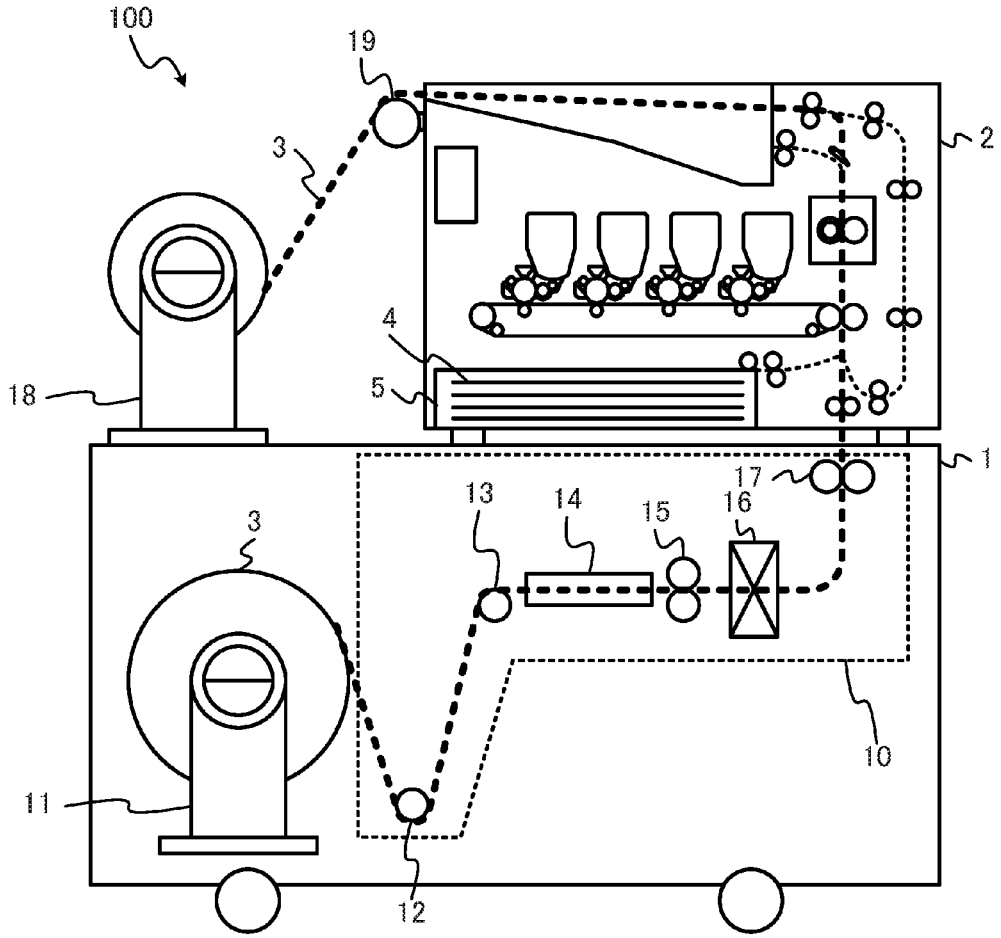
FIG. 1 is a diagram illustrating a structure of a printing device according to an embodiment of the present disclosure.

Further objects and advantages of the present disclosure will be set forth in the description which follows, and in part will be apparent from the description, or may be learned by practice of the present disclosure. The objects and advantages of the present disclosure may be realized and obtained by means of the instrumentalities and combinations particularly pointed out hereinafter.

The accompanying drawings are incorporated in a part of the specification, and constitute a part of the specification to illustrate embodiments of the present disclosure. In addition, the accompanying drawings together with the general description given above and the detailed description of the embodiments given below serve to explain the principles of the present disclosure.

Embodiments of the present disclosure will be described below in detail with reference to the accompanying drawings. Note that components of the same or equivalent functions in the drawings are indicated by the same reference signs.

FIG. 1 illustrates a structure of a printing device 100 including a paper feeding device 1, and an image forming device 2 according to an embodiment of the present disclosure.

This printing device 100 employs a structure in which the image forming device 2 capable of printing a cut sheet 4 that is a cut recording medium is placed and stacked on the paper feeding device 1 feeding a roll paper 3 that is a rolled recording medium longer than the cut sheet 4. The image forming device 2 is also capable of printing the roll paper 3 fed from the paper feeding device 1.

The paper feeding device 1 winds off the roll paper 3 in sequence which is the paper wound around a winding center (a paper tube) in a rolled shape, and conveys the roll paper to the image forming device 2. More specifically, the paper feeding device 1 includes a holder (an unwinder) 11 and a conveyer 10 both provided in the paper feeding device, and further includes a winder (a rewinder) 18 provided above the holder and the conveyer.

The holder 11 is a member to hold the roll paper 3 to be supplied to the image forming device 2. The holder 11 includes a rotatable rotating shaft (a shaft) which passes through the winding center of the roll paper 3, and which holds the roll paper 3, and a support stage that supports the rotating shaft. The holder rotatably holds the roll paper 3.

The holder 11 is equipped with an unillustrated motor to rotate the rotating shaft. The holder 11 rotates, by driving this motor, the rotating shaft at a number of rotations per an instructed unit time, winds off the holding roll paper 3, and feeds the roll paper to the conveyer 10.

The conveyer 10 conveys the roll paper 3 by the holder 11 along a conveying route, and supplies the conveyed roll paper to the image forming device 2. More specifically, the conveyer 10 includes a tension roller 12, a follower roller 13, a paper setup unit 14, a paper conveying roller pair 15, a guillotine cutter 16, and a main-box-entry conveying roller pair 17.

The tension roller 12 is disposed right after the holder 11 of the conveyer 10, and controls so as not to have any slack in the roll paper 3 that is fed from the holder 11. The tension roller 12 is disposed so as to be movable in a vertical direction, and moves downwardly in the vertical direction due to force, such as a self-weight or a spring to apply back tension to the roll paper 3 that is being conveyed. By the function of such a tension roller 12, constant tension (tension) applied to the roll paper 3 is maintained, thereby stabilizing the conveyance of the roll paper 3.

The follower roller 13 is a roller which rotates, in conjunction with the roll paper 3 being conveyed, around the positionally-fixed rotating shaft. The follower roller 13 is disposed at the downstream side of the tension roller 12 in a conveying route, and serves to adjust a conveying direction of the roll paper 3.

The paper setup unit 14 is a unit prepared for an operator to set paper. More specifically, as illustrated in FIG. 2, the interior of the paper feeding device 1 can be pulled out in the direction along an arrow in the figure, and the paper setup unit 14 includes a pair of rotatable presser bars.

Figure 2:
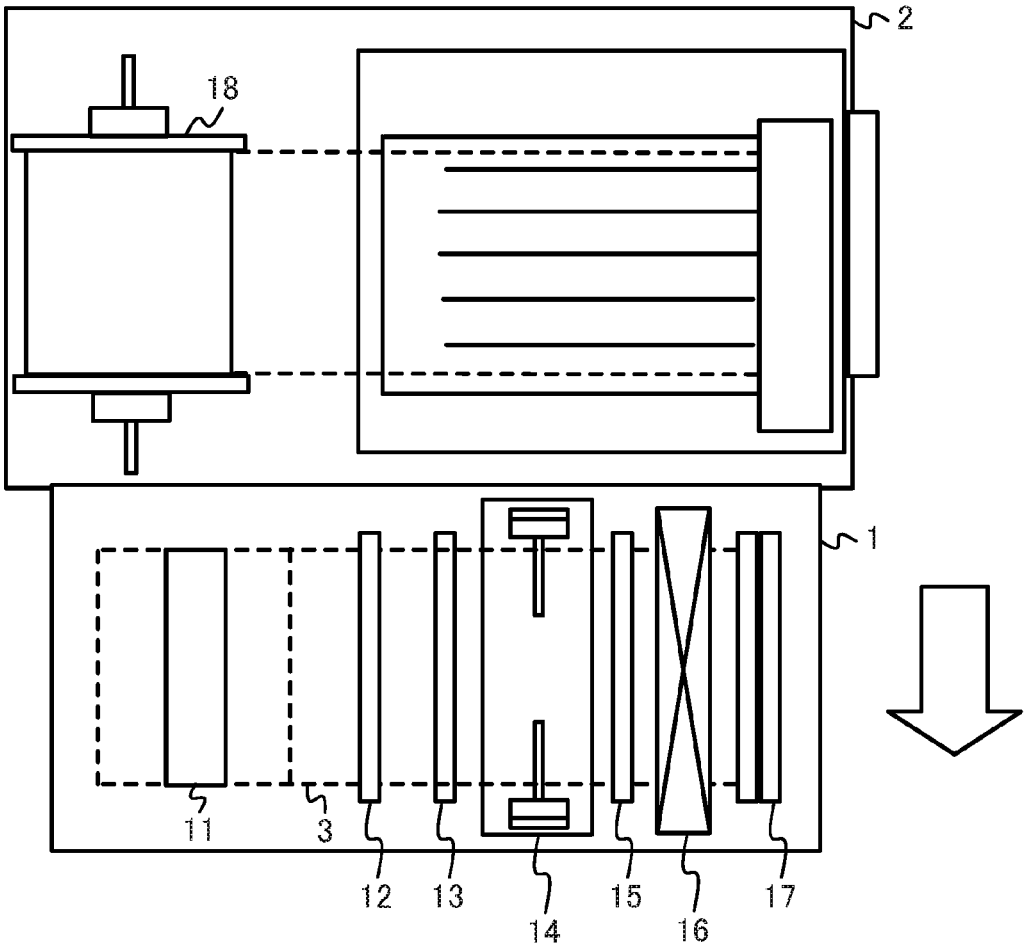
FIG. 2 is a plan view illustrating a paper feeding device that is being opened.

In the condition illustrated in FIG. 2, the operator tucks, into the paper conveying roller pair 15, the roll paper 3 from the holder 11, and then presses the roll paper 3 placed on the paper setup unit 14 by the pair of presser bars.

The paper conveying roller pair 15 is a roller pair to convey, to a subsequent convey mechanism, the roll paper 3 set by the paper setup unit 14. More specifically, the paper conveying roller pair 15 is driven and controlled by an unillustrated motor, and a clutch that controls transmission of a driving force from the motor.

The guillotine cutter 16 is a cutter to cut out the roll paper 3. The guillotine cutter 16 cuts the back end of the roll paper 3 vertically at, for example, an appropriate timing at which the roll paper 3 with a necessary length for image formation by the image forming device 2 has been conveyed.

The main-box-entry conveying roller pair 17 is a roller pair located at the downstream side relative to the paper conveying roller pair 15, and feeds the roll paper 3 in the image forming device 2. More specifically, the main-box-entry conveying roller pair 18 is driven and controlled by the motor for the paper conveying roller pair 15, and a clutch that controls transmission of the driving force from this motor.

An operation of setting the roll paper 3 will be explained in detail. First, as illustrated in FIG. 2, the operator pulls out the interior of the paper feeding device 1 in the direction along the arrow. Next, after the roll paper 3 is set on the holder 11, the roll paper 3 is drawn out from the holder 11 and is caused to pass through the lower space of the tension roller 12, and to pass through the upper space of the follower roller 13. Subsequently, the operator draws out the roll paper 3 up to the paper setup unit 14 holds the roll paper between the paper conveying roller pair 15, and presses the roll paper 3 by the pair of presser bars.

In this condition, when the paper feeding device 1 is closed, the set roll paper 3 is detected by appropriate sensors, and the paper conveying roller pair 15 rotates and drives. This causes the roll paper 3 to pass through the guillotine cutter 16 and be fed to the main-box-entry conveying roller pair 17, and, stands by at a home position right before the entry to the image forming device 2.

Conversely, the winder 18 disposed on the paper feeding device 1 is a member that rewinds and holds the roll paper 3 ejected from the image forming device 2. Like the holder 11, the winder 18 includes a rotatable rewinding shaft (a shaft) which passes through the winding center (the paper tube) of the roll paper 3, and which holds the roll paper 3, and, a support stage that supports the rewinding shaft. The winder rotatably holds the roll paper 3.

The winder 18 is equipped with an unillustrated motor to rotate the rewinding shaft. By driving this motor, the winder 18 rotates the rewinding shaft at a number of rotations per an instructed unit time, and rewinds the roll paper 3 fed from the image forming device 2 through a follower roller 19.

Next, the image forming device 2 is a printer main box which is placed and stacked on the paper feeding device 1, and which prints the roll paper 3 fed from the paper feeding device 1, or prints the cut sheet 4 fed from a local paper feeding tray 5. When printing the roll paper 3, the image forming device 2 serves as, for example, a label printer, and sequentially prints labels that are sticking papers pasted on the roll paper 3 which serves as a mounting sheet.

Next, an internal structure of the image forming device 2 will be explained with reference to FIG. 3. In the following explanation, an electrophotographic, secondary-transfer and tandem color printer will be explained as an example image forming device 2. The image forming device 2 includes the paper feeding tray 5, a pick-up roller 6, a paper feeding roller pair 7, a main-box conveying roller pair 8, an image forming mechanism 20, an intermediate transfer belt unit 30, a fixing device 40, a flapper 50, a paper ejecting roller pair 60, a switchback roller pair 70, and a turnover mechanism 80.

The paper feeding tray 5 is a tray to place multiple cut sheets 4. In this case, the cut sheets are each a paper that is cut out in a predetermined size (A4, B4, and the like). The paper feeding tray 5 may have multiple tray stages in accordance with the size of the cut sheet 4.

The pick-up roller 6 is a roller to send out, to a paper conveying route, an uppermost cut sheet 4 among the multiple placed cut sheets 4.

The paper feeding roller pair 7 is a roller pair to convey the cut sheet 4 sent out by the pick-up roller 6 to a secondary transfer roller 36 located at the downstream side.

The main-box conveying roller pair 8 nips the roll paper 3 fed by the main-box-entry conveying roller pair 17 of the paper feeding device 1, and conveys the roll paper 3 to the secondary transfer roller 36.

This secondary transfer roller 36 is disposed so as to contact a follower roller 33 with a pressure via a transfer belt 31, and forms a secondary transfer mechanism that performs secondary transfer of a toner image on the belt face of the transfer belt 31 to the roll paper 3 or the cut sheet 4.

The image forming mechanism 20 employs a structure in which four image forming units 21 (21*k*, 21*c*, 21*m*, and 21*y*) are arranged side by side in series. Among the four image forming units 21, the image forming units 21*c*, 21*m*, and 21*y* form a color image with color toners of cyan (C), magenta (M), and yellow (Y), respectively. In contrast, the image forming unit 21*k* forms a black-and-white image with black (K) toners.

Each image forming unit 21 includes a photoreceptor drum 22 at the bottom. The photoreceptor drum 22 has an outer circumference that is formed of, for example, an organic photoconductive material. Disposed near the photoreceptor drum 22 so as to surround the outer circumference thereof are a cleaner 23, an electrically-charged roller 24, an optical writing head 25, and a developing roller 27 of a developer 26.

The developer 26 includes a toner container which is disposed at an upper part and which contains any of the black (K), cyan (C), magenta (M), and yellow (Y) toners, a toner resupplying mechanism for a lower part disposed at a middle part, and the developing roller 27 disposed at a lower part.

Figure 3:
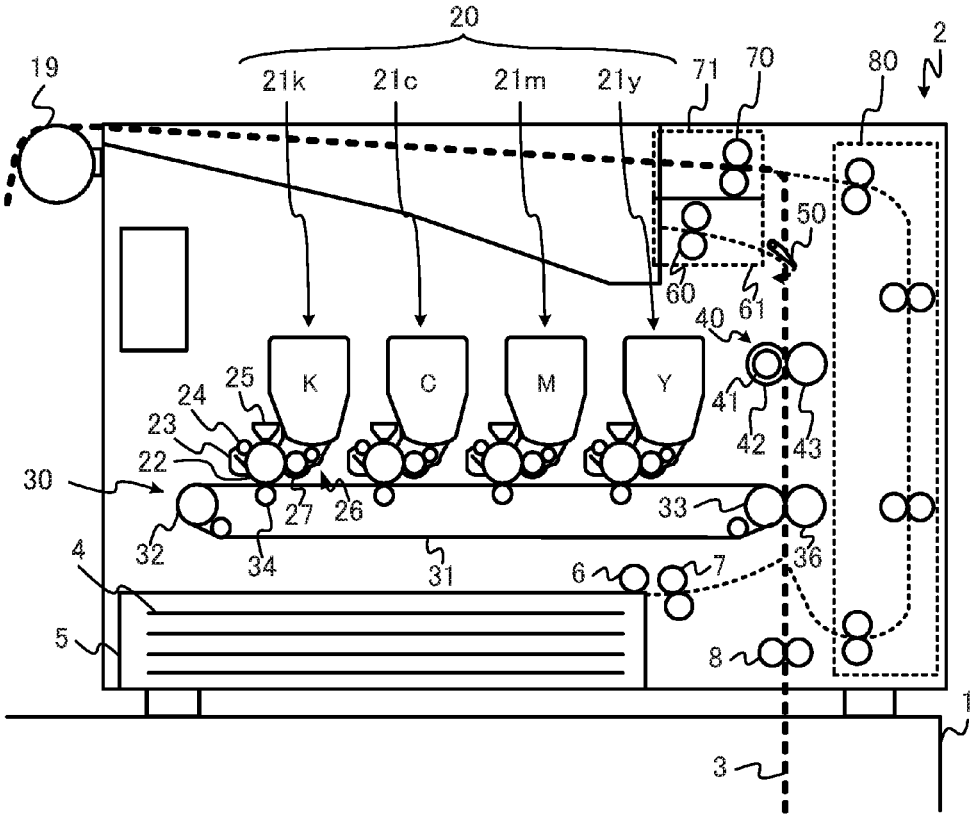
FIG. 3 is a cross-sectional view illustrating an internal structure of an image forming device.

Although reference numerals are given only to the structural members of the image forming unit 21*k* for black (K) in FIG. 3, each image forming unit 21 employs the same structure except the color of the toner contained in the toner container.

The intermediate transfer belt unit 30 includes, the endless transfer belt 31, a driving roller 32 that runs this transfer belt 31 in a counterclockwise direction, and the follower roller 33. The transfer belt 31 conveys, to a transfer position, a toner image that has been directly transferred (primary transfer) on the belt face in order to transfer (secondary transfer) this toner image to the roll paper 3 or the cut sheet 4.

The intermediate transfer belt unit 30 includes four primary transfer rollers 34 corresponding to the four image forming units 21*k*, 21*c*, 21*m*, and 21*y*. Each primary transfer roller 34 rotates at an instructed rotation cycle, and causes the transfer belt 31 to be in contact with the photoreceptor drum 22, and to be apart from the photoreceptor drum 22.

The fixing device 40 includes a heating roller 42 having a built-in heater 41, and a pressure roller 43 that contacts the heating roller 42 with a pressure. The fixing device 40 heats and applies pressure to unfixed toners on the roll paper 3 or the cut sheet 4, thereby to fix the toners after the secondary transfer.

The flapper 50 changes a conveying route to either a normal paper ejecting route 61 that has the paper ejecting roller pair 60 or a switchback route 71 that has the switchback roller pair 70. The flapper 50 is supported by the rotating shaft in a manner rotatable therearound, and swings in the direction along an arrow in the figure to change the conveying route. Details on a changing control with this flapper will be discussed later.

The paper ejecting roller pair 60 is a roller pair that stiffens the cut sheet 4, and then ejects paper to the exterior. In order to improve the paper ejecting performance of the cut sheet 4, the paper ejecting roller pair 60 slightly infects the cut sheet 4 in an orthogonal direction (a widthwise direction of the cut sheet 4) to the ejecting direction, and stiffens (enhances a rigidity) to the cut sheet when ejecting the cut sheet 4 from an ejection opening of the image forming device 2. As a scheme of stiffening the cut sheet 4, there is a scheme of providing an additional stiffener coaxial with one paper ejecting roller of the paper ejecting roller pair 60 is applicable. This stiffener has an outer diameter that is larger than that of the one paper ejecting roller so as to apply, to the cut sheet 4, wavy deformation as viewed from the ejecting direction of the cut sheet 4, thereby enhancing a rigidity of the cut sheet 4 in the ejecting direction, and also improving the ejecting performance of the cut sheet 4. Note that the paper ejecting roller pair 60 is also referred to as a second roller pair.

The switchback roller pair 70 is a roller pair that performs switchback in a reverse direction to the conveying direction when both sides of the cut sheet 4 are printed with the cut sheet 4 being conveyed and partially ejected to the exterior.

That is, the switchback roller pair 70 is capable of changing the operation between to convey the cut sheet 4 in the conveying direction or to perform switchback conveyance in the reverse direction to the ejecting direction. Since the switchback roller pair 70 is utilized to turn-over the direction of the cut sheet 4, no stiffener separate from the one switchback roller is provided coaxially with that of the one switchback roller of the switchback roller pair 70, and thus no stiffening is performed to improve the stacking performance. Note that the switchback roller pair 70 serves as a first roller pair, and a conveyance direction changer.

Note that the normal paper ejecting route 61 is a conveying route through which the cut sheet 4 is subjected to stiffening and ejected to the exterior, and the switchback route 71 is a conveying route through which the cut sheet 4 is conveyed in the ejecting direction or the reverse direction to the ejecting direction by the switchback roller pair 70. In addition, the normal paper ejecting route 61 is also referred to as a second route, while the switchback route 71 is also referred to as a first route. Note that the first roller pair in combination with the first route is also referred to as a first ejecting mechanism, while the second roller pair in combination with the second route is also referred to as a second ejecting mechanism.

The turnover mechanism 80 includes multiple conveying roller groups, turns over the cut sheet 4, and feeds the unprinted face to the secondary transfer mechanism while conveying the cut sheet 4 having undergone the switchback by the switchback roller pair 70. Note that a conveying route with this turnover mechanism 80 is also referred to as a turnover route.

Next, a structure with respect to a control of the image forming device 2 will be explained with reference to FIG. 4.

The image forming device 2 is mutually connected with a PC 9, and the paper feeding device 1 via a network like a Local Area Network (LAN) or a Universal Serial Bus (USB).

The image forming device 2 includes a control block 90. The control block 90 includes a CPU 91, a LAN communicator 92, a USB communicator 93, a panel controller 94, an operation panel 95, a storing device 96, a job analyzer 97, a route selector 98, and a conveyance controller 99.

The CPU 91 is connected with each component of the image forming device 2 via a system bus that is a transmission route to transfer instructions and data, and controls the operation of each component of the image forming device 2. The CPU 91 reads, while utilizing unillustrated Read Only Memory (ROM) and Random Access Memory (RAM) as work memories, various programs like a system software stored in the ROM or the storing device 96, and executes the read programs as needed.

The LAN communicator 92 and the USB communicator 93 communicate with the external device via the LAN and the USB, respectively. For example, the CPU 91 communicates with the PC 9 and the paper feeding device 1 via the LAN communicator 92 or the USB communicator 93, receives a print job transmitted from the PC 9, and transmits a conveyance request of the roll paper 3 to the paper feeding device 1.

The panel controller 94 is connected with the operation panel 95 that includes a display panel like a Liquid Crystal Display (LCD), and an input device that has various operation buttons. The panel controller 94 displays, on the operation panel 95 under the control of the CPU 91, various images, characters, symbols, and the like.

In addition, the panel controller 94 accepts various operations given by the user and input to the operation panel 95, and supplies, to the CPU 91, operation signals corresponding to various accepted operations.

The storing device 96 is a non-volatile memory like an Electrically Erasable Programmable ROM (EEPROM) or a Hard Disk Drive (HDD). The storing device 96 stores various programs (for example, programs for a route selecting process which will be discussed later), and various data which will be necessary for the image forming device 2 to operate. The storing device 96 stores, for example, data on a conveying speed when the roll paper 3 is conveyed, and data on a conveying speed when the cut sheet 4 is conveyed.

The job analyzer 97 analyzes a print job transmitted from the PC 9, and a print job relating to a print instruction given by the user and input to the operation panel 95, and, specifies whether a medium subjected to printing is the cut sheet 4 or the roll paper 5.

In addition, when the medium subjected to printing is the cut sheet 4, the job analyzer 97 specifies, based on the print job, whether to print the cut sheet on single side or on both sides. Note that the job analyzer 97 serves as a recording medium specifier.

The route selector 98 controls the flapper 50, and selects either route that is the normal paper ejecting route 61 (the second route) or the switchback route 71 (the first route). More specifically, the route selector 98 controls an unillustrated motor that drives the rotating shaft of the flapper 50 to swing the flapper 50, thereby selecting the route. In addition, the route selector 98 is also referred to as a ejecting mechanism selector.

The conveyance controller 99 controls, as needed, each roller (the paper feeding roller pair 7, the main-box conveying roller pair 8, the secondary transfer roller 36, the paper ejecting roller pair 60, the switchback roller pair 70, the conveying roller group inside the turnover mechanism 80, and the like) inside the image forming device 2, and controls the conveyance of the roll paper 3 or the cut sheet 4. More specifically, the conveyance controller 99 controls, as needed, a number of rotations, the forward rotation, the backward rotation, and the like of an unillustrated motor that rotates and drives each roller so as to control the conveying speed of the paper to be conveyed, the turnover direction, and the like.

In the printing device 100 explained above with reference to FIG. 1 to FIG. 4, a feature is, for example, the route selecting process of selecting either the normal paper ejecting route 61 or the switchback route 71. The flow of the route selecting process with respect to this feature will be explained with reference to a flowchart of FIG. 5.

Assuming that the user has given a start printing instruction through the operation panel 95 or the PC 9. The controller 50 of the image forming device 2 accepts (S11) a print job of the start printing instruction, which causes to start the route selecting process in FIG. 5.

More specifically, when the user gives a printing start instruction through the PC 9, the control block 90 receives, via the LAN communicator 92 or the USB communicator 93, the print job containing print data, a printing setup condition, and the like that are transmitted from the PC 9. Conversely, when the user gives the printing start instruction through the operation panel 95, the control block 90 receives the print job containing the print data, the printing setup condition, and the like via the panel controller 94.

Next, the job analyzer 97 determines (S12) whether or not printing is to be performed on the roll paper 3. More specifically, the job analyzer 97 determines whether or not the printing is to be performed on the roll paper 3 based on the printing setup condition (for example, mode information indicating either a roll paper printing mode or a cut sheet printing mode) contained in the print job.

In this case, when the job analyzer 97 determines (S12: YES) that printing is to be performed on the roll paper, the control block 90 transmits (S13) a conveyance request of the roll paper 3 to the paper feeding device 1. More specifically, the controller 50 transmits, to the paper feeding device 1 via the LAN communicator 52 or the USB communicator 53, a request to feed the roll paper 3 in order to execute printing. In response to this conveyance request, the paper feeding device 1 starts feeding the roll paper 3 in the home position toward the image forming device 2.

Figure 6:
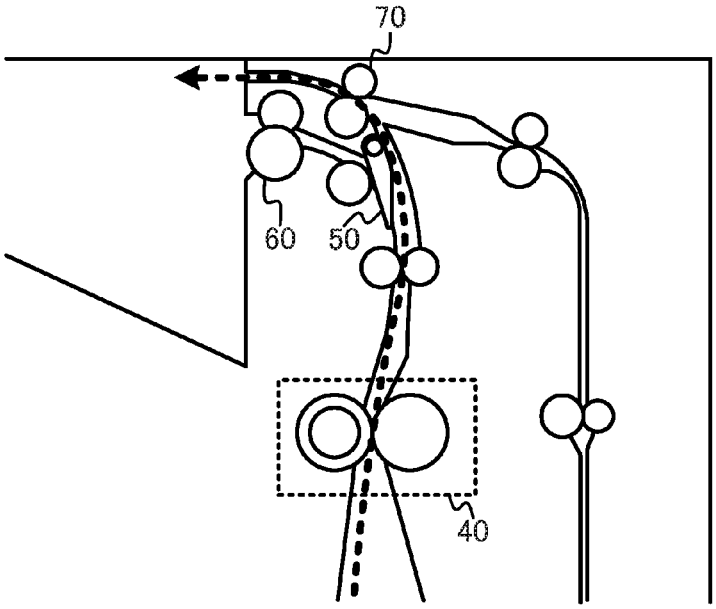
FIG. 6 is an enlarged view when paper is ejected through a switchback route.

Next, the route selector 98 selects (S14) the switchback route 71. More specifically, as illustrated in FIG. 6, the route selector 98 controls the flapper 50 to select the switchback route 71. Hence, the switchback route 71 is selected as a paper ejecting route for the roll paper 3 after this roll paper is fed from the paper feeding device 1, and the image is formed on this roll paper. Subsequent to the process in the step S14, the route selecting process ends. Note that the process in the step S13 and that of the step S14 may be executed simultaneously.

Conversely, when the job analyzer 97 determines (S12: NO) that printing is not to be performed on the roll paper, the job analyzer 97 determines that printing is to be performed on the cut sheet, and further determines (S15) whether or not the printing is a single side printing to the cut sheet 4.

Figure 7:
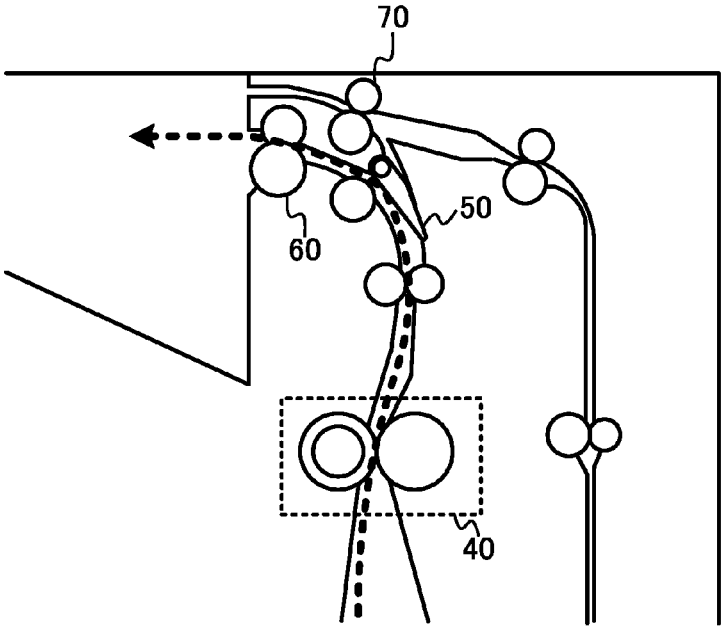
FIG. 7 is an enlarged view when paper is ejected in a normal paper ejection route.

In this case, when the job analyzer 97 determines (S15: YES that the printing is a single side printing to the cut sheet 4, the route selector 98 selects (S16) the normal paper ejecting route 61. More specifically, as illustrated in FIG. 7, the route selector 98 controls the flapper 50 to select the normal paper ejecting route 61. Hence, the normal paper ejecting route 61 is selected as a paper ejecting route for the cut sheet 4 after this cut sheet is fed from the paper feeding tray 5 and the image is formed on this cut sheet. Subsequent to the process in the step S16, the route selecting process ends.

Conversely, when the job analyzer 97 determines (S15: NO) that the printing is not a single side printing to the cut sheet 4, the job analyzer determines that the printing is a double-sided printing to the cut sheet, and the route selector 98 selects (S14) the switchback route 71. More specifically, as illustrated in FIG. 6, the route selector 98 controls the flapper 50 to select the switchback route 71. Hence, the switchback route 71 is selected as a route to perform switchback for the cut sheet 4 after the image is formed on a single side of this cut sheet 4. Subsequent to the process in the step S14, the route selecting process ends.

Subsequent to the route selecting process, the image is formed on the roll paper 3 fed from the paper feeding device 1 or the cut sheet 4 fed from the paper feeding tray 5. Next, in the case of roll paper printing, the conveyance controller 99 conveys the roll paper 3 having undergone image formation in the direction along an arrow (ejecting direction) in FIG. 6 in order to eject this roll paper to the exterior through the switchback route 71. More specifically, the conveyance controller 9 keeps rotating the switchback roller pair 70 in the forward direction so as to convey the roll paper in the conveying direction. The roll paper 3 ejected to the exterior is wound by the winder 18 via the follower roller 19.

Conversely, when double-sided printing is performed on the cut sheet 4 having undergone image formation on a single side, the conveyance controller 99 rotates the switchback roller pair 70 in the forward direction, and conveys the cut sheet in the ejecting direction. Next, the conveyance controller 99 once de-actuates the switchback roller pair 70 when a part of the cut sheet 4 is ejected to the exterior, and then rotates the switchback roller pair in the backward direction so as to perform the switchback conveyance on the cut sheet 4 in the reverse direction to the ejecting direction. Accordingly, the cut sheet 4 is fed in the turnover route, and is conveyed while having both sides of the cut sheet turned over by the conveyance roller group of the turnover mechanism 80, and thus the side of the cut sheet 4 not having undergone printing yet can be fed to the secondary transfer mechanism.

As described above, through the process in FIG. 5, when printing is to be performed on the roll paper, the image forming device 2 of the printing device 100 selects the switchback route 71 as the paper ejecting route for the roll paper 3 having undergone image formation. Hence, no stiffening is performed on the roll paper 3, enabling a conveyance of the roll paper while reducing a load at the time of paper ejection.

In particular, in the case of the roll paper on which sticking papers like labels are pasted, no load is applied to the stuck portions of the labels and the perforated portions thereof during label printing. Thus, the roll paper 3 can be conveyed and ejected without causing sticking papers like labels to be peeled off. In addition, since no stiffening is performed on the roll paper 3, deformations of the roll paper 3 and stiffening signs caused by the stiffening can be prevented.

Modified Examples

The embodiments were fully explained above, but it should be understood that the aforementioned embodiments are merely examples, and that the specific structures, details of the processes, and the like of the printing device 100, paper feeding device 1, and image forming device 2 should not be limited to the aforementioned embodiments.

For example, in the aforementioned embodiments, the flapper 50 was utilized to change the route, but the present disclosure is not limited to this structure. The route may be changed using any kind of members as long as the route can be changed between the normal paper ejecting route 61 and the switchback route 71.

Figure 5:
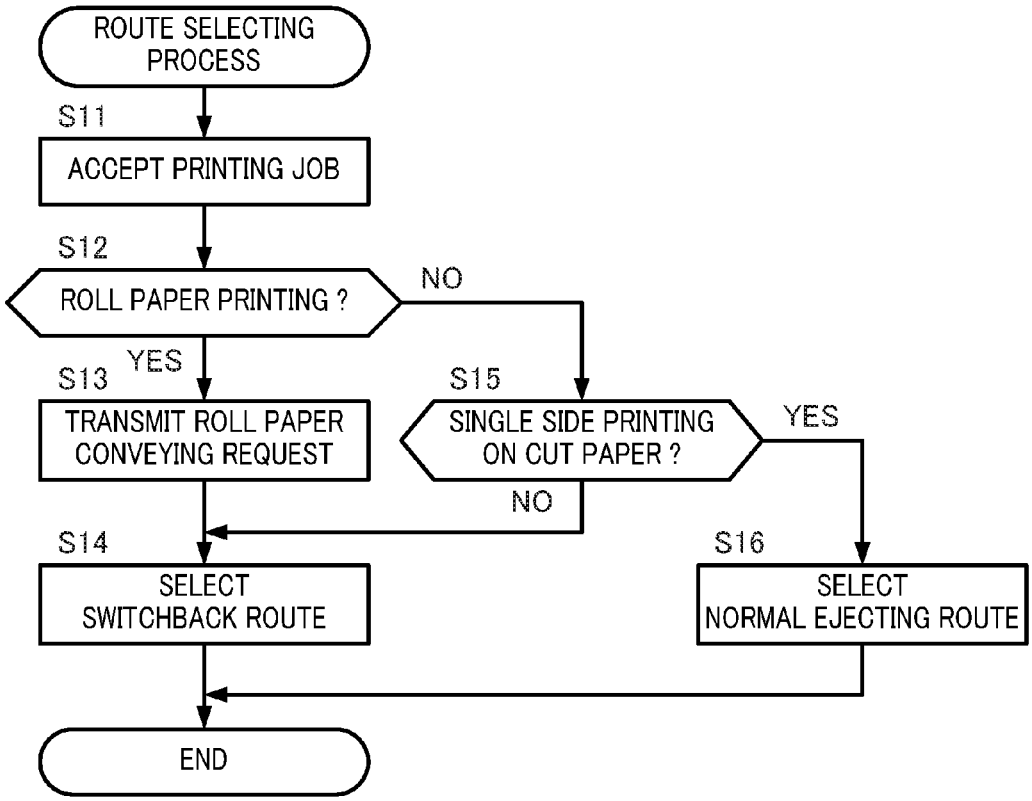
FIG. 5 is a flowchart illustrating a flow of a route selecting process of the image forming device.

In addition, in the aforementioned embodiments, in the route selecting process in FIG. 5, the switchback route 71 is selected when printing is to be performed on the roll paper, but an exception process may be added. For example, in the route selecting process, when the switchback route 71 is once selected but the control block 90 detects, for example, a paper jam during the conveyance of the roll paper 3, the route selector 98 may select the normal paper ejecting route 61 as the paper ejecting route for the roll paper. Note that the control block 90 serves as a recording medium jam detector in this case.

According to this structure, when it is necessary to eject the roll paper 3 to the exterior due to a paper jam and the like (that is, in a case in which the roll paper is to be stacked on the paper ejection tray without being rewound by the winder 18), the paper ejecting roller pair 60 in the normal paper ejecting route 61 can stiffen and eject the jammed roll paper. Note that the jammed portion of the roll paper 3 is normally discarded, thus there is no technical problem even if stiffening is performed.

Still further, in the aforementioned embodiments, it was assumed that the printing device 100 has the image forming device 2 placed and stacked on the paper feeding device 1 (that is, the image forming device 2 and the paper feeding device 1 are separate devices), but the present disclosure is not limited to this structure. For example, the image forming device 2, and the paper feeding device 1 may be integral to construct the printing device 100.

Figure 4:
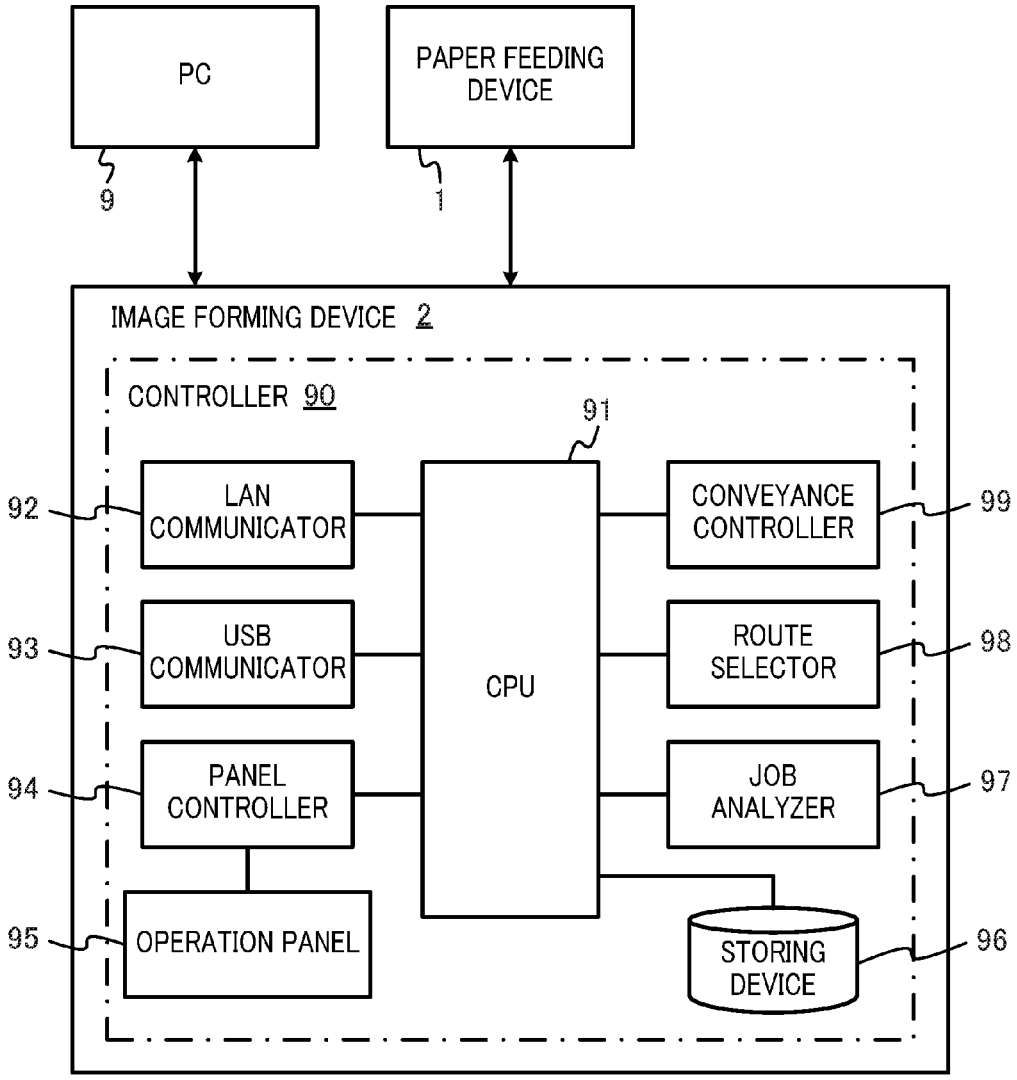
FIG. 4 is a block diagram with respect to a control of the image forming device.

In this case, the printing device 100 includes respective components of the control block 90 illustrated in FIG. 4, and executes the above route selecting process in FIG. 5. In this case, since the image forming device 2 is integral with the paper feeding device 1, the process in the step S13 (the process of transmitting, to the paper feeding device 1, the conveyance request of the roll paper 3 from the image forming device 2) can be omitted.

Figure 8:
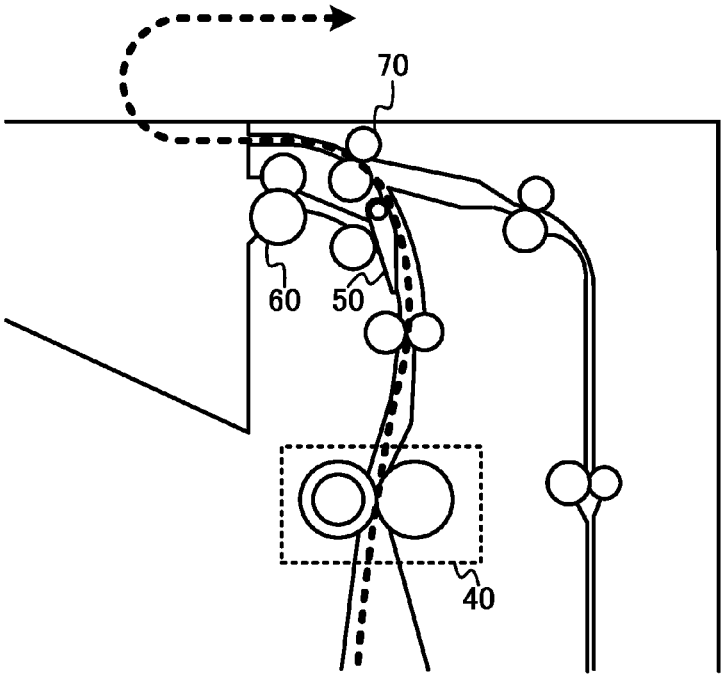
FIG. 8 is an enlarged view when a face-up paper ejection is performed through a switchback route.

Yet still further, in the aforementioned embodiments, the roll paper 4 in the face-down condition (the print side is directed downwardly) is ejected from the switchback route 71, and is rewound by the winder 18, but the present disclosure is not limited to this structure. For example, the roll paper in the face-up condition (the print side is directed upwardly) may be ejected from the switchback route 71 (see FIG. 8). Since the switchback route 71 is located at an upper position than that of the normal paper ejecting route 61, a turn-back operation can be performed more easily than the normal paper ejecting route 61. Hence, the printing condition (for example, printing position to the label, peeling of the label, and the like) of the roll paper 3 can be checked more promptly than the rewinding by the winder 18.

Moreover, in the aforementioned embodiments, the electrophotographic, secondary-transfer and tandem color printer is the example image forming device 2. However, the route selecting process of the present disclosure is applicable to any kind of image forming devices as long as such image forming devices include the normal paper ejecting route 61 and the switchback route 71, and perform printing on the roll paper. The route selecting process is applicable to other types of printers, such as a primary transfer printer, and an inkjet printer.

Furthermore, each function of the image forming device 2 (the printing device 100 when the image forming device 2 and the paper feeding device 1 are integral) of the present disclosure (each function of, for example, the job analyzer 97, the route selector 98, or the conveyance controller 99) may be realized by a normal computer like a PC.

More specifically, in the aforementioned embodiments, the explanation was given of the case in which the program of the image forming device 2 are stored in the storing device 96 beforehand. However, this program may be installed in a computer to construct a computer capable of executing each of the above functions. Note that it is needless to say that the program may be stored in not only the storing device 96 but also other non-transitory computerreadable recording medium (a flexible disk, a CD-ROM, a DVD, an MO, or the like), and distributed to a computer.

In addition, the program may be stored in a disk device or the like of a server device over a communication network like the Internet, and, for example, downloaded to a computer.

Preferable embodiments of the present disclosure were described above, but the present disclosure is not limited to such particular embodiments, and it should be understood that the present disclosure covers the invention as recited in the appended claims and the equivalent range thereto.

This application claims the priority based on Japanese Patent Application No. 2013-189468 filed on Sep. 12, 2013, the entire contents of which is herein incorporated in this specification by reference.

The invention claimed is:

1. A printing device comprising:

a first ejector that ejects a recording medium to an exterior;

a second ejector that enhances a rigidity of the recording medium more than when the recording medium is ejected by the first ejector, and ejects the recording medium to the exterior; and an ejector selector that selects either the first ejector or the second ejector;

wherein the ejector selector selects the second ejector when the recording medium is a cut recording medium, and selects the first ejector when the recording medium is a wound recording medium in a rolled shape;

wherein the first ejector comprises a conveying-direction changer that changes a conveying direction of the recording medium in an ejecting direction or a reverse direction to the ejecting direction.

2. The printing device according to claim 1, wherein the second ejector comprises a stiffener that makes the recording medium curved.

3. The printing device according to claim 1, wherein the first ejector is located at an upper location with respect to the second ejector.

4. The printing device according to claim 1, further comprising a recording medium jam detector that detects a recording medium jam, wherein when the recording medium jam detector detects the recording medium jam, the ejector selector selects the second ejector even if the recording medium being conveyed is a longer recording medium than the cut recording medium.

* * * * *